US008950855B1

(12) United States Patent
LeFevre et al.

(10) Patent No.: US 8,950,855 B1
(45) Date of Patent: Feb. 10, 2015

(54) SYSTEM AND METHOD FOR HIGHLIGHTING PRINTED MATERIAL ON A DOCUMENT

(71) Applicant: Xerox Corporation, Norwalk, CT (US)

(72) Inventors: Jason M. LeFevre, Penfield, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/087,510

(22) Filed: Nov. 22, 2013

(51) Int. Cl.
*B41J 2/01* (2006.01)
*B41J 11/00* (2006.01)

(52) U.S. Cl.
CPC ..... *B41J 11/0015* (2013.01); *B41J 2/01* (2013.01)
USPC ..... 347/101; 347/104

(58) Field of Classification Search
CPC ..... B41J 2/2114; B41J 11/0015; B41J 2/01; B41M 5/52; B41M 7/00
USPC ..... 347/101, 104
See application file for complete search history.

(56) References Cited

U.S. PATENT DOCUMENTS

| | | | | |
|---|---|---|---|---|
| 4,451,530 | A | 5/1984 | Kaule et al. | |
| 6,165,592 | A | 12/2000 | Berger et al. | |
| 6,506,476 | B1 | 1/2003 | Kaule et al. | |
| 8,262,134 | B2 | 9/2012 | Schwenk et al. | |
| 8,333,870 | B2 | 12/2012 | Burchard et al. | |
| 8,355,169 | B2 | 1/2013 | Hersch et al. | |
| 2009/0232527 | A1 * | 9/2009 | Shida | 399/44 |
| 2010/0020151 | A1 * | 1/2010 | Jones et al. | 347/104 |
| 2012/0273576 | A1 * | 11/2012 | Tomczyk et al. | 235/488 |

* cited by examiner

*Primary Examiner* — Manish S Shah
*Assistant Examiner* — Yaovi Ameh
(74) *Attorney, Agent, or Firm* — Maginot Moore & Beck LLP

(57) ABSTRACT

An inkjet printer and a method of operating an inkjet printer provide a luminescent background for facilitating viewing of indicia printed on porous media in no-light or low-light conditions. The printer and method apply a first enhancement material to a surface of porous media to which ink has been applied to form indicia and a second enhancement material to a back side of porous media. The two enhancement materials combine through the porous media to provide a luminescent background for the indicia printed on the media. The two surfaces of the porous media can be covered with laminating material to protect the enhancement materials.

16 Claims, 3 Drawing Sheets

SYSTEM AND METHOD FOR HIGHLIGHTING PRINTED MATERIAL ON A DOCUMENT

TECHNICAL FIELD

The present disclosure relates generally to inkjet printing systems, and, more particularly, to inkjet printing systems that enhance visibility of printed materials.

BACKGROUND

In general, inkjet printing machines or printers include at least one printhead unit that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the printhead onto media or an imaging member. Such printheads can generate temperatures of approximately 110 to 120 degrees Celsius. Once the ejected ink is on media, the ink droplets solidify. The printhead unit ejects ink from a plurality of inkjet nozzles, also known as ejectors.

Some inkjet printers use solid ink, which is also known as phase change ink. After the melted ink is on the media, the ink solidifies and then is warmed by a heater to soften the ink on the media. The softened ink is then fixed to the media by a pressurized nip formed by a spreader drum, which includes a hard surface or non-conformable surface, and pressure roller, which includes a compressible surface. An oil, also known as release agent, is deposited on the surface of the spreader drum and is spread by a metering device, typically a urethane metering blade. As the media with softened ink moves through the nip, the oil on the surface of the spreader drum prevents the compressed ink from offsetting to the spreader drum. After the media image has been compressed to fix the image to the media, the media can be directed to finishing equipment which applies a coating/varnish, such as a latex based coating, which provides a protective barrier to the deposited ink and which can also provide a selected finish, such as a glossy finish, to the final documents. The finishing equipment also cuts the continuous web into sheets.

One issue arising from printed materials is the ability to read or perceive indicia on documents in no-light or low-light conditions. The ability to place materials in the inks used or on the media are susceptible to wear or perseverance of the ability of the materials to enhance the readability of the indicia in no-light or low-light conditions. Consequently, systems or methods that enable the readability of indicia in no-light or low-light conditions are desirable.

SUMMARY

A system that enhances the readability of printed indicia uses two different chemicals that interact through the media on which the materials are applied. The system includes a first applicator operatively connected to a supply of a first enhancement material, the first applicator being positioned to apply the first enhancement material onto a surface of a porous media onto which ink has been ejected to form indicia, a second applicator operatively connected to a supply of a second enhancement material, the second applicator being positioned to apply the second enhancement material onto a surface of the porous media that is opposite the one onto which the ink has been ejected, and a laminating system configured to apply a laminating material to the surface of the porous media onto which the ink has been ejected and the surface of the porous media opposite the one onto which the ink has been ejected.

A method of operating a printing system to enhance the readability of printed indicia produced by the system uses two different chemicals that interact through the media on which the materials are applied. The method includes operating a first printhead to eject ink onto porous media with reference to image data stored in a memory operatively connected to a controller that operates the first printhead, applying a first enhancement material with a first applicator to a surface of the porous media onto which the first printhead ejected ink, applying a second enhancement material with a second applicator to a surface of the porous media opposite the surface of the porous media to which the first printhead ejected ink, and applying a laminating material to the surface of the porous media onto which the first printhead ejected ink and to the surface of the porous media opposite the one onto which the first printhead ejected ink.

DETAILED DESCRIPTION

Figure 1:
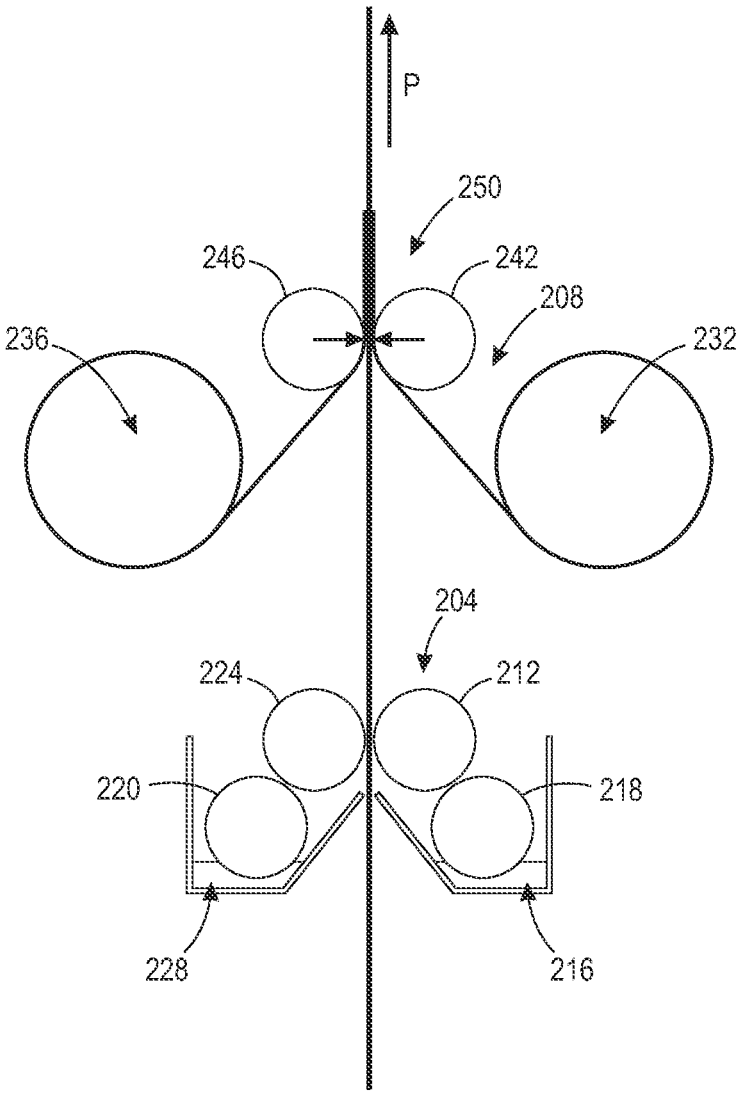
FIG. 1 is schematic diagram of a system configured to apply enhancement materials to both surfaces of printed media and to laminate the treated media

For a general understanding of the environment for the system and method disclosed herein as well as the details for the system and method, the drawings are referenced throughout this document. In the drawings, like reference numerals designate like elements. As used herein the term "printer" or "printing system" refers to any device or system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or print medium, and the term "cross-process direction" is a direction that is perpendicular to the process direction along the surface of the image receiving member. As used herein, the terms "web," "media web," and "continuous web of recording media" refer to an elongated print medium that is longer than the length of a media path that the web moves through a printer during the printing process. Examples of media webs include rolls of paper or polymeric materials used in printing. The media web has two sides having surfaces that are each configured to receive images during printing. The printed surface of the media web is made up of a grid-like pattern of potential drop locations, sometimes referred to as pixels.

Figure 3:
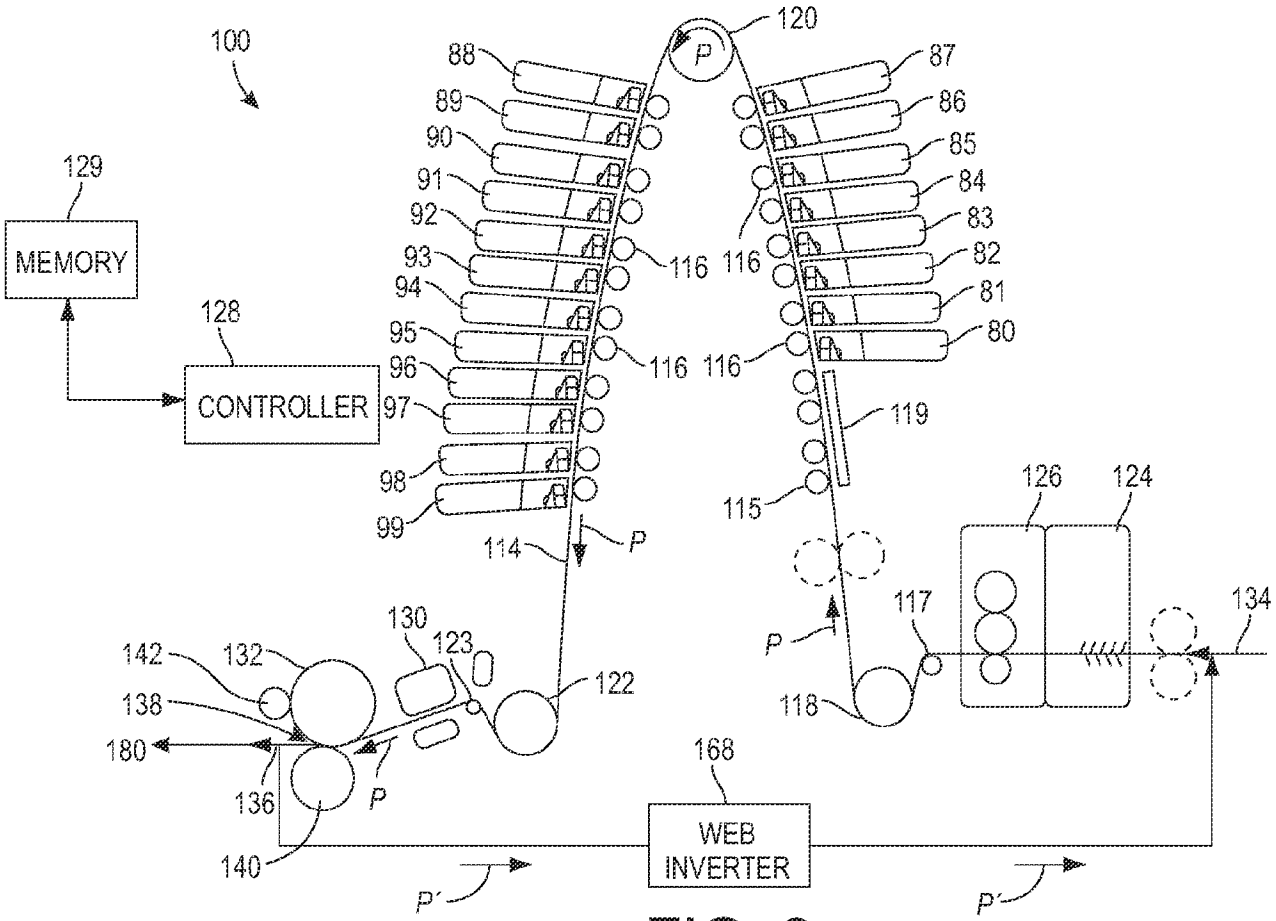
FIG. 3 PRIOR ART
FIG. 3 is a schematic view of a prior art inkjet printing system that images a continuous web of media as the media advances past the printheads of the printing system.

FIG. 3 depicts a prior art inkjet printer 100 having elements pertinent to the present disclosure. In the embodiment shown, the printer 100 implements a solid (phase change) ink print process for printing onto a continuous media web. Although a system and method for optimized release agent output for in-line coating are described below with reference to the printer 100 depicted in FIG. 3, the subject method and apparatus disclosed herein can be used in any printer, such as a cartridge inkjet printer, which uses serially arranged printheads to eject ink onto a continuous web image substrate.

FIG. 3 depicts a continuous web printer system 100 that includes twenty print modules 80-99, a controller 128, a memory 129, guide roller 115, guide rollers 116, pre-heater roller 118, apex roller 120, leveler roller 122, tension sensors 152A-152B, 154A-154B, and 156A-156B, and velocity sensors, such as encoders 160, 162, and 164. The print modules 80-99 are positioned sequentially along a media path P and form a print zone from a first print module 80 to a last print module 99 for forming images on a print medium 114 as the print medium 114 travels past the print modules. Each print module 80-83 provides a magenta ink. Each print module 84-87 provides cyan ink. Each print module 88-91 provides yellow ink. Each print module 92-95 provides black ink. Each print module 96-99 provides a clear ink as a finish coat. In all other respects, the print modules 80-99 are substantially identical.

The media web travels through the media path P guided by rollers 115 and 116, pre-heater roller 118, apex roller 120, and leveler roller 122. A heated plate 119 is provided along the path adjacent roller 115. In FIG. 3, the apex roller 120 is an "idler" roller, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader drum 132 are located at the opposite end 136 of the media path P.

The spreader drum 132 generates a pressurized nip 138 with a pressure roller 140 disposed adjacently to the spreader drum 132. A drum maintenance unit 142 located adjacently to the spreader roller 132, delivers a release agent, typically silicone oil, to the spreader drum 132 to enable fixing of the phase change ink to the continuous web. As the imaged continuous web moves through the heater 130, the phase change ink is heated such that the ink image is softened before the continuous web enters the pressurized nip 138. The phase change ink is flattened to the continuous web while passing through the pressurized nip 138. The release agent applied to the spreader drum 132 prevents the heated ink from offsetting from the continuous web to the surface of spreader drum. In some embodiments, the spreader drum 132 is also heated to maintain the heated state of the phase change ink when entering the nip 138.

A web inverter 168 is configured to direct the media web 114 from the end 136 of media path P to the beginning 134 of the media path through an inverter path P'. The web inverter 168 flips the media web and the inverter path P' returns the flipped web to the inlet 134 to enable single-engine ("Mobius") duplex printing where the print modules 80-99 form one or more ink images on a second side (second side ink image) of the media web after forming one or more images on the first side (first side ink image). In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 80-99 is configured to eject ink drops onto both sections of the media web. Each of the rollers 115, 116, 118, 120, and 122 also engage both the first and second sections of the media web. After the second side of the media web 114 is imaged, the media web 114 passes the end of the media path 136. Registration of a second side ink image to a first side ink image forms a duplex image. In another embodiment, one print module is configured to span the width of the recording media, such that two print modules located side by side are used to eject ink on the first and second sections of the web.

As illustrated in FIG. 3, each of the print modules 80-99 includes an array of printheads that are arranged across the width of both the first section of web media and second section of web media. Ink ejectors in each printhead in the array of printheads are configured to eject ink drops onto predetermined locations of both the first and second sections of media web 114.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 80-99. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also hold one or more values that identify tension levels for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Referring now to FIG. 1, the prior art printer system 100 is modified to include a system that applies luminescent chemicals to enhance the readability of printed indicia on a document. The word "luminescent" as used in this document refers to the production of visible light without using heat to produce the light. The words "luminescent chemicals" as used in this document refer to chemicals that produce visible light when mixed together. That is, the chemical reaction between two luminescent chemicals produces visible light. Although the following discussion is directed to the application of luminescent chemicals and laminating material to the continuous web output by printer 100 at position 180, the principles of the system and method described below could be used with a printer that prints media sheets. Each sheet or selected sheets output from such a printer could be supplied to a chemical application station and a laminating station, such as those described below, for the application of the luminescent chemicals and laminating materials.

The system 200 shown in FIG. 1 includes a chemical application station 204 and a laminating station 208. The system 200 is positioned to receive the web after the web has been printed and has exited the printer 100, which is denoted with reference number 180 in FIG. 1. The chemical application station 204 includes a first applicator 212 operatively connected to a supply of a first enhancement material 216 through roller 218, and a second applicator 224 operatively connected to a supply of a second enhancement material 228 through roller 220. Roller pairs 212/218 & 224/220 are configured to use the "film-splitting" process, which is common to many traditional printing presses for metering a known amount of fluid to a substrate. The first applicator 212 is positioned to apply the first enhancement material onto a surface of the porous web 114 that has been printed by at least one printhead in the printer 100. As used in this document, "porous" refers to a substrate having a void-space volume to total substrate volume ratio that is in a range of about 15 percent to about 75 percent. The void space in a substrate can be aft or fluid, as is the case in coated substrates. The second applicator 224 is positioned to apply the second enhancement material onto a surface of the porous web 114 that is opposite the printed side of the porous web 114. "Enhancement materials," as used in this document, refer to substances that improve visibility of areas to which they are applied when combined. The first enhancement material and the second enhancement material are luminescent chemicals. As used in this document, "luminescent chemicals" are chemicals that produce visible light when mixed together. Because the web is porous, the two enhancement materials migrate into the web in areas where no ink is present and there they contact one another. The contact between these chemicals produces low light levels that enable the unprinted areas of the web to emit light. In one embodiment, the first enhancement material is a luminescent dye mixed with diphenyl oxylate and the second enhancement material is hydrogen peroxide. In some embodiments, the luminescent dye and diphenyl oxylate are mixed with the hydrogen peroxide in a 1:1 ratio, although in other embodiments the dye solution is mixed with the hydrogen peroxide in a ratio of 4:1 or higher. In general, the ratio for mixing the two enhancement chemicals is determined empirically with reference to experimental results for length of light exposures, illuminating light intensities, the constituent elements of the chemicals, and other factors for activating the luminescence of the areas where the two chemicals are applied.

The application of the enhancement materials that become luminescent when they interact is particularly advantageous with substrates printed with solid ink or phase change inks. These inks are generally undisturbed by the enhancement chemicals as the enhancement materials migrate into the unprinted, i.e., area devoid of the solid ink. Consequently, the unprinted background areas produce visible light and the foreground areas defined by the generally impermeable solid ink maintain the integrity of the printed indicia illuminated by the background areas.

The two applicators and their respective supplies that comprise chemical application station 204 are film split applicators. Film split applicators are typically comprised of a metering roller, such as roller 218, which rotates in a sump of the fluid to be applied. The metering roller can have a wiper blade, which is typically made of urethane, positioned to engage the metering roller to both spread the fluid and remove excess fluid from the roller so a known amount of the fluid is on the metering roller. The metering roller forms a nip and rotates with an applicator roller, such as 212, to transfer approximately fifty percent of the fluid on the metering roper to the applicator roller. That is, the fluid film on the metering roller is split between the metering roller and the applicator roller in the nip. The applicator roller then applies the film to the material passing through a nip formed between the two applicator rollers. Alternatively, the chemical application station could be comprised of one or more printheads on each side of the web 114 that eject one of the enhancement materials on one side of the web 114. In this embodiment, each printhead or arrangement of printheads on one side of the web is supplied with one of the enhancement materials and the printhead or arrangement of printheads on the other side of the web is supplied with the other enhancement material. While the applicators depicted in FIG. 1 include a pair of rollers to pull an enhancement material from a sump and apply it to the web 114, the applicators could be a single roller that sits in the sump to contact the enhancement material directly and apply the material to the web 114.

The laminating station system 208 is configured to apply a laminating material to each surface of the porous media web 114. The laminating system includes a pair of supply rolls 232, 236 of laminating material and a pair of rollers 242, 246 that form a nip 250 through which the porous media and the laminating material on each side of the porous media web 114 pass to fix the laminating material to both sides of the porous media. Examples of laminating materials include, but are not limited to, various plastic films, such as polypropylene, cellophane, and the like. As shown in FIG. 1, the supply roll 232 is positioned on the printed side of the porous media web and the other supply roll is positioned on the opposite side of the porous media web. The pressure in the nip 250 is sufficient to cause the laminating material to adhere to the surface of the web to which the laminating material is pressed. The laminated web can be cut to form separate laminated sheets or wound onto a roller for delivery to a post-printing processing station. The laminating material helps hold the luminescent chemical in the porous media to improve the life of the luminescent chemicals in the media. Storage of the laminated media in areas at which the temperature is kept at or below ambient conditions also helps the luminescent chemicals remain active in the media. That is, cooling the media to a temperature below ambient air, which is typically in a range centered about 25 degrees C., helps preserve the life of the luminescent chemicals.

Figure 2:
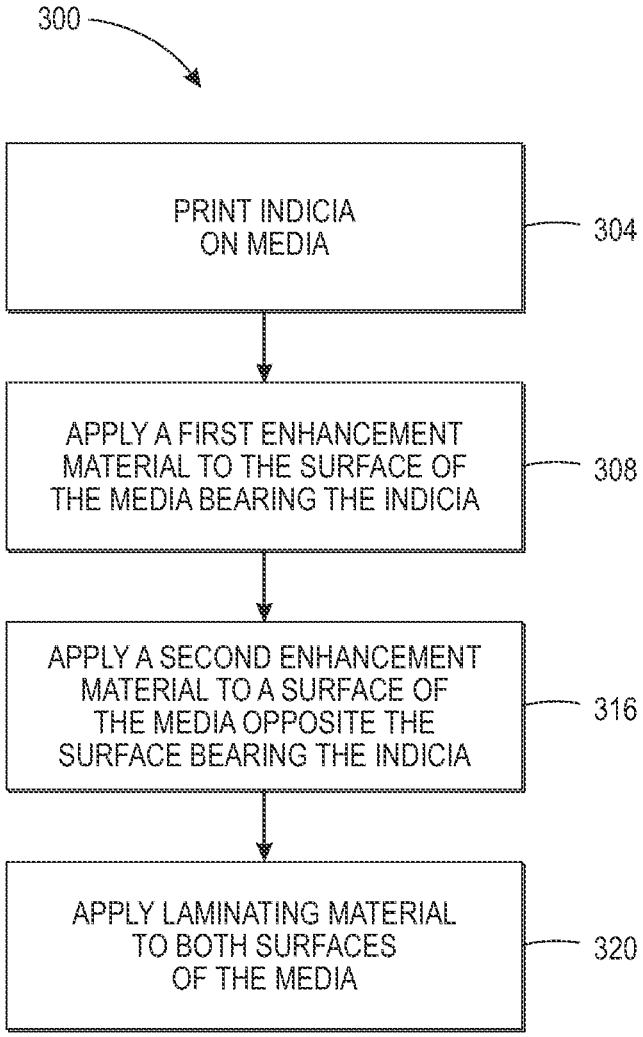
FIG. 2 is a flow diagram of a process for operating a printer to apply enhancement materials to both surfaces of printed media and to laminate the treated media.

A method of operating a printer to produce printed documents with luminescent backgrounds is shown in FIG. 2. In the description of this method, statements that a process is performing some task or function refers to a controller or general purpose processor executing programmed instructions stored in a memory operatively connected to the controller or processor to manipulate data or to operate one or more components in the printer to perform the task or function. The controller 128 noted above can be such a controller or processor. Alternatively, the controller 128 can be implemented with more than one processor and associated circuitry and components, each of which is configured to form one or more tasks or functions described herein.

The method 300 begins with the controller operating at least one printhead to eject ink onto porous media with reference to image data stored in a memory operatively connected to a controller that operates the first printhead (block 304). A first enhancement material is applied with a first applicator to a surface of the porous media onto which the first printhead ejected ink (block 308), and a second enhancement material is applied with a second applicator to a surface of the porous media opposite the surface of the porous media to which the first printhead ejected ink (block 316). A laminating material is then applied to both surfaces of the porous media (block 320).

The laminating material is applied to the porous media by positioning the laminating material from a first supply roll of laminating material proximate the printed surface of the porous media and by positioning the laminating material from a second supply roll of laminating material proximate the surface of the porous media opposite the printed surface. The porous media and the laminating material proximate the two surfaces of the porous media are passed through a nip formed by a pair of rollers to fix the laminating material to both sides of the porous media as noted above. The first enhancement material and the second enhancement material can be applied with a printhead operatively connected to a supply of one of the enhancement materials or with a film split applicator as described above.

It will be appreciated that variants of the above-disclosed and other features and functions, or alternatives thereof, can be desirably combined into many other different systems, applications or methods. Various presently unforeseen or unanticipated alternatives, modifications, variations or improvements can be subsequently made by those skilled in the art that are also intended to be encompassed by the following claims.

What is claimed is:

1. A system rendering a document luminescent comprising:

a first applicator operatively connected to a supply of a first enhancement material, the first applicator being positioned to apply the first enhancement material onto a surface of a porous media onto which ink has been ejected to form indicia;

a second applicator operatively connected to a supply of a second enhancement material, the second applicator being positioned to apply the second enhancement material onto a surface of the porous media that is opposite the one onto which the ink has been ejected, the first enhancement material and the second enhancement material combining to form a luminescent background to the indicia formed on the surface of the porous media; and a laminating system configured to apply a laminating material to the surface of the porous media onto which the ink has been ejected and the surface of the porous media opposite the one onto which the ink has been ejected.

2. The printing system of claim 1, the laminating system further comprising:

a pair of supply rolls of laminating material, one of the supply rolls being positioned to face the surface of the porous media on which ink has been ejected and the other supply roll being positioned to face a surface of the porous media opposite the one onto which the ink has been ejected, the pair of supply rolls applying laminating material to each surface of the porous media; and a pair of rollers that form a nip through which the porous media and the laminating material on each surface of the porous media passes to fix the laminating material to both sides of the porous media.

3. The printing system of claim 2, the first applicator further comprising:

a supply of the first enhancement material; and a roller in contact with the first enhancement material provided from the supply of the first enhancement material, the roller being positioned to contact the surface of the porous media onto which the ink has been ejected.

4. The printing system of claim 2, the second applicator further comprising:

a supply of the second enhancement material; and a roller in contact with the second enhancement material provided from the supply of the first enhancement material, the roller being positioned to contact the surface of the porous media opposite the surface onto which the ink has been ejected.

5. The printing system of claim 2, the first applicator further comprising:

a supply of the first enhancement material; and a second printhead fluidly connected to the supply of the first enhancement material, the second printhead being configured to eject the first enhancement material onto the surface of the porous media onto which the ink has been ejected.

6. The printing system of claim 2, the second applicator further comprising:

a supply of the second enhancement material; and a second printhead fluidly connected to the supply of the second enhancement material, the second printhead being configured to eject the second enhancement material onto the surface of the porous media opposite the surface onto which the ink has been ejected.

7. The printing system of claim 1 wherein the first enhancement material is a mixture of a dye and diphenyl oxylate.

8. The printing system of claim 7 wherein the second enhancement material essentially consists of hydrogen peroxide.

9. A method of operating a printing system comprising:

operating a first printhead to eject ink onto porous media to form an indicia on the surface of the porous media with reference to image data stored in a memory operatively connected to a controller that operates the first printhead;

applying a first enhancement material with a first applicator to a surface of the porous media onto which the first printhead ejected ink;

applying a second enhancement material with a second applicator to a surface of the porous media opposite the surface of the porous media to which the first printhead ejected ink;

forming a luminescent background to the indicia formed on the surface of the porous media as the first enhancement material and the second enhancement material combine; and applying a laminating material to the surface of the porous media onto which the first printhead ejected ink and to the surface of the porous media opposite the one onto which the first printhead ejected ink.

10. The method of claim 9, the application of the laminating material further comprising:

positioning the laminating material from a first supply roll of laminating material proximate the surface of the porous media to which the first printhead ejected ink;

positioning the laminating material from a second supply roll of laminating material proximate the surface of the porous media opposite the surface onto which the first printhead ejected ink; and passing the porous media and the laminating material proximate the two surfaces of the porous media through a nip formed by a pair of rollers to fix the laminating material to both sides of the porous media.

11. The method of claim 9, the application of the first enhancement material further comprising:

applying with a first roller the first enhancement material to the surface of the porous media onto which the first printhead ejected ink.

12. The method of claim 9, the application of the second enhancement material further comprising:

applying with a first roller the first enhancement material to the surface of the porous media onto which the first printhead ejected ink.

13. The method of claim 9, the application of the first enhancement material further comprising:

ejecting the first enhancement material from a second printhead fluidly connected to a supply of the first enhancement material onto the surface of the porous media onto which the first printhead ejected ink.

14. The method of claim 9, the application of the second enhancement material further comprising:

ejecting the second enhancement material from a second printhead fluidly connected to a supply of the second enhancement material onto the surface of the porous media opposite the surface onto which the first printhead ejected ink.

15. The method of claim 9 wherein the first enhancement material is a mixture of a dye and diphenyl oxylate.

16. The method of claim 15 wherein the second enhancement material essentially consists of hydrogen peroxide.

* * * * *